US009439244B2

(12) United States Patent
Verstraeten

(10) Patent No.: US 9,439,244 B2
(45) Date of Patent: Sep. 6, 2016

(54) HEATING CABLE COMPRISING STEEL MONOFILAMENTS

(75) Inventor: Steve Verstraeten, Antwerp (BE)

(73) Assignee: NV BEKAERT SA, Zwevegem (BE)

( * ) Notice: Subject to any disclaimer, the term of this patent is extended or adjusted under 35 U.S.C. 154(b) by 159 days.

(21) Appl. No.: 14/005,961

(22) PCT Filed: Mar. 1, 2012

(86) PCT No.: PCT/EP2012/053500

§ 371 (c)(1),
(2), (4) Date: Sep. 18, 2013

(87) PCT Pub. No.: WO2012/136418

PCT Pub. Date: Oct. 11, 2012

(65) Prior Publication Data

US 2014/0008351 A1 Jan. 9, 2014

(30) Foreign Application Priority Data

Apr. 4, 2011 (EP) ..... 1160971

(51) Int. Cl.

| | |
|---|---|
| ***H05B 3/10*** | (2006.01) |
| ***H05B 3/02*** | (2006.01) |
| ***H05B 3/12*** | (2006.01) |
| ***H05B 3/56*** | (2006.01) |

(52) U.S. Cl.

CPC *H05B 3/02* (2013.01); *H05B 3/12* (2013.01); *H05B 3/56* (2013.01); *Y10T 29/49083* (2015.01)

(58) Field of Classification Search

CPC ..... H05B 3/56; H05B 3/565; H05B 3/58; H05B 3/54; H05B 3/342; H05B 3/12; H05B 3/02; H05B 2203/011; H05B 2203/014; H05B 2203/017; D02G 3/12; D02G 3/441; D02G 3/446; Y10T 29/49083; Y10T 29/49195; Y10T 29/49117; Y10T 29/49201; H01B 9/003; H01B 9/006; H01B 13/22; H01B 13/00; H01B 1/02; H01B 3/427; B60N 2/5625

See application file for complete search history.

(56) References Cited

U.S. PATENT DOCUMENTS

| | | | | |
|---|---|---|---|---|
| 2,966,648 | A * | 12/1960 | Morey | H05B 3/56 174/107 |
| 8,331,602 | B2 * | 12/2012 | Liu | H04R 1/1033 174/113 R |
| 2008/0099458 | A1 | 5/2008 | Hilmer | |
| 2010/0038112 | A1 * | 2/2010 | Grether | D07B 1/02 174/128.1 |
| 2011/0114619 | A1 | 5/2011 | Amils | |

FOREIGN PATENT DOCUMENTS

| | | | |
|---|---|---|---|
| CN | 2 230 494 | Y | 7/1996 |
| DE | 43 12 622 | A1 | 10/1994 |
| DE | 10 2005 050 459 | B3 | 3/2007 |
| EP | 1 507 904 | A1 | 2/2005 |
| EP | 1 507 905 | A1 | 2/2005 |
| WO | 03/095724 | A1 | 11/2003 |
| WO | 03/095725 | A1 | 11/2003 |
| WO | 2010/009972 | A1 | 1/2010 |

OTHER PUBLICATIONS

International Search Report in Application No. PCT/EP2012/053500, Jun. 4, 2012.

* cited by examiner

*Primary Examiner* — Shawntina Fuqua

(74) *Attorney, Agent, or Firm* — Bacon & Thomas, PLLC

(57) ABSTRACT

A new heating cable is described. The heating cable is comprising between seven and two hundred metallic monofilaments of a first type which are acting as electrical conductors to generate heat. The metallic monofilaments of a first type are having a diameter ranging from 30 μm to 100 μm. The metallic monofilaments of a first type are having a substantially round cross section. The metallic monofilaments of a first type are comprising a steel layer with a chromium content of less than 10% by weight. The heating cable is having an electrical resistance ranging between 0.1 Ω/m and 20.0 Ω/m when measured at 20° C.

9 Claims, 1 Drawing Sheet

HEATING CABLE COMPRISING STEEL MONOFILAMENTS

TECHNICAL FIELD

The present invention relates to a heating cable having metal conductors adapted for heating purposes; and to the use of such a cable. Examples of applications of such heating cable are e.g. in car seat heating and in heating of garments.

BACKGROUND ART

U.S. Pat. No. 2,966,648 discloses an electric heating element that is comprising an elongated flexible flat high-temperature heating ribbon. The heating element is further comprising a tubular sheathing comprising fine high temperature resistant metal wires. The sheathing is provided around the heating ribbon. The fine high temperature resistant metal wires are provided to reinforce the heating element while providing a flexible heating element, they are not used as electrical conductor (they are electrically insulated from the heating ribbon) and are therefore not participating in the generation of heat in the electric heating element. The metal wires may be of any suitable corrosion and high-temperature resistance alloy, as, for example, stainless steel, Inconel, Nichrome or Kanthal.

Cables for heating applications that are comprising a multiple of metallic filaments as electrical conductors (and participating in the heat generation) are known. Cables for car seat heating are more and more widely applied in modern vehicles. Copper or copper alloy lacquered cables are used. The advantage of copper is its high specific electrical conductivity combined with a good plastic deformation. The disadvantage of copper is a low flex life, i.e. a low resistance to repeated bending cycles, and the limitation in electrical resistance range given the high electrical conductivity of copper.

Besides for car seat heating applications, heating cables are used for other applications, e.g. in garments.

In practice when using copper cables the range of electrical resistance is limited to 0.40 Ω/m (Ohm/meter), at maximum up to 0.50 Ω/m. The range between 0.50 Ω/m and 2.0 Ω/m is difficult, if not impossible, to reach. The resistance values that are indicated are resistance values at 20° C. Of course one could limit the number of filaments in the cable or reduce the diameter of the filaments in order to increase the electrical resistance. For example, a cable of twenty copper filaments with each a diameter of 50 μm has an electrical resistance of approximately 0.43 Ω/m (at 20° C.). This construction 20*50 μm is already at the lower limit regarding number of filaments and filament diameter and will give an unacceptably low strength and lifetime, especially a low flex life.

Alternatives are being provided by combining the good electrical conductivity of copper with the higher strength, higher flex life and higher electrical resistance of stainless steel. EP-A-1507904 discloses such a combination cable where stainless steel cores are provided with a copper coating. EP-A-1507905 discloses an alternative combination cable where stainless steel filaments are intertwined with copper filaments, both types of filaments are used as electrical conductors and are participating in the generation of heat. While offering advantages as to an increased flex life, these combination cables have the drawback of requiring at least two different materials, namely stainless steel and copper to obtain the required electrical resistance values and have the drawback that the range of electrical resistance is still too limited because of the high conductivity of copper.

A further drawback of existing heating cables is that the cable itself does not contain a safety function in case the heating cable gets overheated. There is a need for having heating cables that have self-regulating characteristics.

SUMMARY OF THE INVENTION

It is an object of the invention to provide a solution for the problems encountered with existing heating cables. It is a specific objective of the invention to provide heating cables, comprising a multiple of metallic filaments that contribute in the generation of heat, for the range of 0.1 Ω/m to 20.0 Ω/m (all electrical resistance values are to be understood as values at 20° C.) and that have acceptable diameters, strength and lifetime while having an inbuilt safety feature against overheating.

It is even a more specific objective to provide heating cables in the range of 0.3 Ω/m to 10 Ω/m (at 20° C.) that have acceptable diameter, strength and lifetime while having an inbuilt safety feature against overheating. It is also a more specific objective to provide heating cables in the range of 0.5 Ω/m to 4 Ω/m (at 20° C.) that have acceptable diameter, strength and lifetime while having an inbuilt safety feature against overheating.

A first aspect of the invention is a heating cable. The heating cable is comprising between seven and two hundred metallic monofilaments of a first type which are acting as electrical conductors to generate heat. The metallic monofilaments of a first type are having a diameter ranging from 30 μm to 100 μm. The metallic monofilaments of a first type are having a substantially round cross section. With substantially round cross section is meant that the cross section is circular, or oval. If the cross section is oval, the difference between the largest and smallest diameter of the cross section is less than 10%, preferably less than 5%, more preferably less than 2% of the largest diameter of the cross section. The metallic monofilaments of a first type are comprising a steel layer with a chromium content of less than 10% by weight. The heating cable is having an electrical resistance ranging between 0.10 Ω/m and 20.0 Ω/m when measured at 20° C.

In heating cables according to the invention, when the temperature of the heating cable increases, the resistance of the heating cable increases also (called PTC: Positive Temperature Coefficient), resulting in a reduction of the power output. Thus, the heating cable in which the power output varies according to its temperature, is self-regulating or self-limiting. Such a heating cable according to the invention is less prone to overheating or burn out thanks to its PTC properties.

In a preferred embodiment, the metallic monofilaments of a first type are having a diameter within the range of 35 μm and 80 μm; preferably, the diameter is between 50 and 80 μm. Even more preferred, the diameter is between 40 μm and 60 μm.

In a preferred embodiment, the electrical resistance of the heating cable is ranging between 0.3 Ω/m and 10 Ω/m when measured at 20° C. More preferably, the electrical resistance of the heating cable is ranging between 0.5 Ω/m and 4 Ω/m when measured at 20° C.

In a preferred embodiment, the heating cable is comprising between seven and seventy-seven metallic monofilaments of a first type.

In a specific embodiment of the invention the metallic monofilament of a first type is devoid of a copper or copper alloy layer. In another specific embodiment, the heating cable is devoid of copper and devoid of copper alloys.

In a specific embodiment of the invention, the nickel content of the steel layer with a chromium content of less than 10% by weight of the metallic filament of a first type, is lower than 1% by weight. Preferably, the nickel content is below 0.5% by weight, more preferably the nickel content is below 0.1% by weight and even more preferably the nickel content is below 0.05% by weight. In the most preferred situation, the nickel content in the steel grade is only traces of nickel.

In another specific embodiment of the invention, the steel part in the steel layer with a chromium content of less than 10% by weight is at least 90% of the metal content by weight of the metallic monofilament of a first type. In a preferred embodiment, the steel layer with a chromium content of less than 10% by weight is at least 95% of the metal content by weight of the metallic monofilament of a first type. In an even more preferred embodiment, the steel layer with a chromium content of less than 10% by weight is at least 98% of the metal content by weight of the metallic monofilament of a first type.

In a specific embodiment of the invention, the steel layer with a chromium content of less than 10% of the metallic monofilament of a first type is a low carbon steel grade. A low carbon steel composition is a steel composition where—possibly with exception for silicon and manganese—all the elements have a content of less than 0.50% by weight, e.g. less than 0.20% by weight, e.g. less than 0.10% by weight. E.g. silicon is present in amounts of maximum 1.0% by weight, e.g. maximum 0.50% by weight, e.g. 0.30% by weight or 0.15% by weight. E.g. manganese is present in amount of maximum 2.0% by weight, e.g. maximum 1.0% by weight, e.g. 0.50% weight or 0.30% by weight. Preferably for the invention, the carbon content ranges up to 0.20% by weight, e.g. ranging up to 0.06% by weight. The minimum carbon content can be about 0.02% by weight. In a more preferred embodiment, the minimum carbon content can be about 0.01% by weight. The low carbon steel composition has mainly a ferrite or pearlite matrix and is mainly single phase. There are no martensite phases, bainite phases or cementite phases in the ferrite or pearlite matrix.

The use of a low carbon steel grade has a number of benefits. A heating cable with high flexibility and good flexlife is obtained. The high flexibility is of interest when using the heating cable in a heating element where the heating cable needs to be given a complex arrangement in the heating element.

In another specific embodiment of the invention, the steel layer with a chromium content of less than 10% of the metallic monofilament of a first type is not a low carbon steel grade, but a high carbon steel grade. With high carbon steel is meant a steel grade having a carbon content between 0.30 and 1.70% by weight. For the invention, preferably high carbon steel grades with carbon content between 0.40 and 0.95% by weight are used, even more preferably high carbon steel grades with carbon content between 0.55% and 0.85% by weight. The high carbon steel grades can contain alloy elements; but for the invention, the high carbon steel grades that are used are having a chromium content of less than 2.5% by weight and a nickel content of less than 1% by weight, preferably a nickel content of less than 0.1% by weight, even more preferably a nickel content of less than 0.05% by weight. And preferably a chromium content of less than 1% by weight.

The use of a high carbon steel grade has a number of additional benefits. The strength of the metallic monofilaments of a first type comprising the high carbon steel layer is higher. The heating cable made with it has been shown to give a higher flexlife when compared to alternative heating cables with similar diameter of metallic monofilaments; e.g. compared to stainless steel monofilament heating cables or compared to heating cables comprising stainless steel layers in the monofilaments.

High carbon steel and low carbon steel are not containing nickel beyond traces. The nickel content is below 0.1%, mostly below 0.05% as only traces of nickel are present. The invention does not relate to nickel steel, nickel steel being a steel grade containing nickel as an alloy element, e.g. up to 6% by weight.

In a specific embodiment of the invention, a heating cable is provided, wherein no other metallic or metal containing fibers or monofilaments are present besides the metallic monofilaments of a first type that are having a diameter ranging from 30 μm to 100 μm, which metallic monofilaments of a first type are having a substantially round cross section, and which metallic monofilaments of a first type are comprising a steel layer with a chromium content of less than 10% by weight.

In a specific embodiment of the invention the monofilaments of a first type are single drawn, i.e. one single filament is drawn through drawing means, in contrast to bundle drawing.

In another specific embodiment of the invention, the metallic monofilaments of a first type have been end drawn, i.e. the process of drawing is the final process in making the metallic monofilaments, no heat treatments follows. A heating cable in which the metallic monofilaments of a first type are end drawn is having an improved flexlife.

In another specific embodiment of the invention, the metallic monofilaments of a first type have been end annealed resulting in the annealed microstructure of the metallic monofilaments in the heating cable. It is of interest that the heating cable made with metallic monofilaments of a first type that have been end annealed is having higher flexibility. Higher flexibility of the heating cable is a benefit when the heating cable has to be bent into a specific shape, e.g. when producing a heating elements comprising the heating cable according to the invention.

In yet another embodiment of the invention, the heating cable is further comprising a metallic monofilament of a second type or one or more bundles of metallic monofilaments of a second type, which is different in composition than the first type. The metallic monofilaments of the second type are used as electrical conductors in the heating cable, and hence are contributing in the generation of heat in the heating cable. In a specific embodiment, the metallic monofilament of a second type, or one or more bundles of metallic monofilaments of a second type can comprise stainless steel. In another specific embodiment, the metallic monofilament of a second type can comprise a steel layer with a chromium content of less than 10% which is different than the layer or layers with a chromium content of less than 10% by weight of the metallic monofilament of a first type. An example of a metallic monofilament of a second type is a metallic monofilament with a steel core and a copper or copper alloy sheath layer. Another example of a metallic monofilament of a second type is a metallic monofilament with a copper or copper alloy core and a stainless steel sheath layer. Another exemplary embodiment is where the heating cable according to the invention comprises one or more bundles of stainless steel monofilaments or stainless steel fibers.

Benefits of heating cables according to the invention in which the heating cable additionally comprises a metallic monofilament of a second type or one or more bundles of metallic monofilaments of a second type is that a heating cable is obtained that is having an electrical resistance that is increasing when the temperature of the heating cable is increased, and that the diameter of the cable, its resistance and its dependence of the electrical resistance with the temperature can be tailored to specific requirements in a much broader range than using only one type of metallic monofilaments. One example is where the diameter of the heating cable must lie within tolerances in order for the heating cable to be mounted in existing connectors into the heating elements in which the heating cable will be used.

In a preferred embodiment, the metallic monofilaments of a first type are forming at least 50% by weight of the metal content of the heating cable, and the metallic monofilaments of a second type are forming at maximum 50% by weight of the metal content of the heating cable. In a more preferred embodiment, the metallic monofilaments of a first type are forming at least 70% by weight of the metal content of the heating cable, and the metallic monofilaments of a second type are forming at maximum 30% by weight of the metal content of the heating cable.

In another specific embodiment of the first aspect of the invention, a heating cable is made via one or more twisting or cabling operations to combine the metallic monofilaments—and if present other fibers, yarns or monofilaments—into the heating cable. The result is then that the heating cable is a twisted and/or cabled construction.

In yet another embodiment of the first aspect of the invention, a heating cable is provided wherein the metallic monofilaments of a first type are comprising a corrosion resistant coating layer. In a specific embodiment, the corrosion resistant coating layer on the metallic monofilament of a first type is a metal coating selected from the group consisting of zinc, tin, silver, nickel, aluminum, or an alloy thereof. Preferably, the corrosion resistant metal coating on the metallic monofilament of a first type is between 1 and 10% by weight of the metallic monofilament of a first type. More preferably, between 2 and 6% by weight. Even more preferably between 3 and 5% by weight. As the metal coating layer is low in weight percentage of the metallic monofilament, it is not affecting the electrical resistance of the metallic monofilament of a first type to a significant extent. As the metallic coating layer is a separate layer, it is not affecting the (electrical) properties of the steel that the metallic monofilament of a first type is comprising, opposite to what is the case when these metals are present as alloy elements in the steel. The benefit of the metal corrosion resistant coating on the metallic monofilament of a first type is that the metallic monofilaments of a first type are better resisting staining and corrosion. This is of interest for the production process of the heating cable according to the invention and for storage of half-products during the production process, but also during installation and use of the heating cable according to the invention.

Specific examples are the use of a nickel coating on metallic monofilaments of a first type; the coating layer being between 2 and 6% by weight of the metallic monofilament of a first type. More preferably the nickel coating is between 3 and 5% by weight of the metallic monofilament of a first type. Specific examples for a nickel coating layer are on a metallic monofilament of a first type comprising low carbon steel or comprising high carbon steel.

Another specific example is use of a zinc coating on metallic monofilament of a first type; the coating layer being between 0.5 and 5% by weight of the metallic monofilament of a first type. More preferably the zinc coating is between 1.5 and 2.5% by weight of the metallic monofilament of a first type. Specific examples for a zinc coating layer are on a metallic monofilament of a first type comprising low carbon steel or comprising high carbon steel.

High carbon and low carbon steel monofilaments with a metallic coating layer (and especially with a zinc coating or with a nickel coating) exist and are used for a number of different applications, e.g. in single wire form, or (in the case of high carbon steel monofilaments) as a twisted or cabled cord for reinforcement applications, e.g. for rubber reinforcement in tires, hoses and belts. The production of a heating cable according to the invention is facilitated and made more cost effective by the use of raw material for the metallic monofilaments of a first type that is already in use for metallic wires for other applications. For use for a heating cable according to the invention, the metallic monofilaments of a first type will need to be drawn further (preferably in single end drawing), to finer diameters, compared to the diameters required for other, existing applications. Where a metallic coating layer is used, the metallic coating layer can be provided on a wire of larger diameter, which is being drawn further as is known in the art to the required end diameter for the metallic monofilament of a first type.

In another specific embodiment of the first aspect of the invention, a heating cable is provided wherein the metallic monofilaments of a first type are comprising a corrosion resistant polymer coating layer. In a more preferred embodiment the corrosion resistant polymer coating on the metallic monofilaments of a first type is a fluorine containing polymer coating layer or a polyurethane coating. Even more preferred, the fluorine containing polymer coating is a perfluoroalcoxy (PFA) polymer or TPE-C or PPS.

In another specific embodiment of the first aspect of the invention, the heating cable has a corrosion resistant sheath. In a more preferred embodiment, the corrosion resistant sheath comprises a polymer layer. Even more preferred, the polymer layer comprises fluorine in the polymer, resulting in superior corrosion resistance and high temperature resistance. Further preferred, the corrosion resistant sheath of the heating cable is perfluoroalcoxy (PFA) or TPE-C or PPS (polyphenylene sulfide).

In a specific embodiment of the invention, the maximum diameter of the heating cable (without coating layer on the heating cable) is 1.7 mm; preferably 0.9 mm, more preferably 0.6 mm. In a specific embodiment of the invention, the maximum diameter of the heating cable including a corrosion resistant sheath is 2 mm, preferably 1.2 mm, more preferably 0.9 mm.

A second aspect of the invention is a method for making a heating cable with an electrical resistance ranging between 0.1 Ω/m and 20.0 Ω/m (measured at 20° C.). The method comprises the step of selecting between seven and two hundred metallic monofilaments of a first type, the metallic monofilaments of a first type are having a diameter ranging from 30 μm to 100 μm, the metallic monofilaments of a first type are having a substantially round cross section, the metallic monofilaments of a first type are comprising a steel layer with a chromium content of less than 10% by weight. The method further comprises the step of twisting and or cabling the metallic monofilaments of a first type and possibly combined with other fibers or yarns to form a heating cable.

In a preferred embodiment of this method, the method comprises the step of selecting between seven and seventy-seven metallic monofilaments of a first type.

An embodiment of the second aspect of the invention is a method for making a heating cable with an electrical resistance ranging between 0.1 Ω/m and 20.0 Ω/m (measured at 20° C.). The method comprises the step of selecting between seven and two hundred metallic monofilaments of a first type, the metallic monofilaments of a first type are having a diameter ranging from 30 μm to 100 μm, the metallic monofilaments of a first type are having a substantially round cross section, the metallic monofilaments of a first type are comprising a steel layer with a chromium content of less than 10% by weight. The method comprises the step of selecting a metallic monofilament of a second type or one or more bundles of metallic monofilaments of a second type. The method further comprises the step of twisting and or cabling the metallic monofilaments of a first type, and the metallic monofilaments of a second type; possibly combined with other fibers or yarns to form a heating cable.

In a preferred embodiment of this method, the method comprises the step of selecting between seven and seventy-seven metallic monofilaments of a first type.

A third aspect of the invention is the use of a heating cable according to the invention. In such use, the metallic monofilaments of the first type, and if present the metallic monofilaments of a second type are making electrical contact with an electrical power supply. One use of a heating cable according to the invention is in car seat heating. Another use is in a heating element in a garment or apparel product, examples are use in a heating element in vests, gloves, stocking or socks. Other uses of the heating cable according to the invention is for SCR (Selective Catalytic Reduction) heating, for the heating of car interiors, for road heating, for floor heating, for wall heating, for carpet heating and for steering wheel heating. The list of uses listed is only given as examples of for the use of the invention. The heating cable according to the invention can be used for a much wider range of heating applications.

BRIEF DESCRIPTION OF FIGURES IN THE DRAWINGS

DETAILED DESCRIPTION OF THE INVENTION

Figure 1:
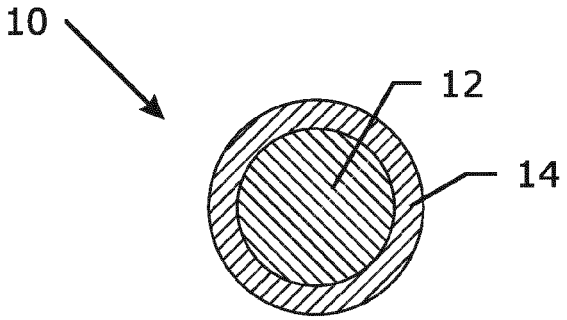
FIG. 1 shows an example of a metallic monofilament of a first type with a metallic coating layer as can be used in the invention.
Figure 2:
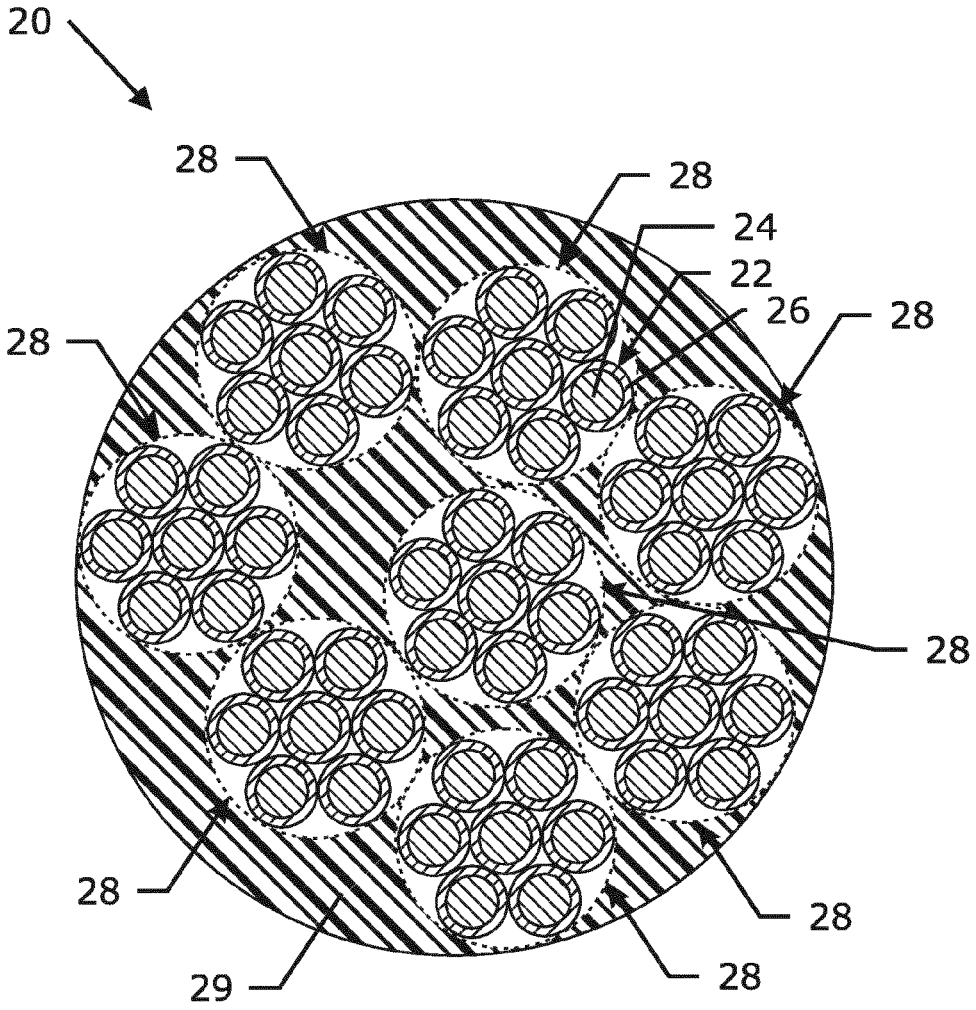
FIG. 2 shows an example of a heating cable construction according to the invention.

FIG. 1 shows an example of a metallic monofilament 10 of a first type with a metallic coating layer as can be used in the invention. The core 12 of the metallic monofilament of the first type is made out of a low carbon steel grade of the following content (percentages are weight percentages; and besides the actual analysis results, the specification is also given for the low carbon steel grade used for this example): C: 0.039% (specification is: 0.02-0.05%), Mn: 0.332% (specification is: <=0.35%), Si: 0.027% (specification is: <=0.025), P: 0.011% (specification is: <=0.025%), S: 0.008% (specification is: <=0.025%), N: 0.005% (specification is: <=0.008%), Cu: 0.013% (specification is: <=0.100%), Cr: 0.043% (specification is: <=0.08%), Ni: 0.018% (specification is: <=0.100%), Al: 0.04% (specification is: <=0.06 en >=0.03%), Mo: 0.007% (specification is: <=0.02%). The metallic monofilament is having a zinc or nickel coating layer 14.

In an example of carrying out the invention a heating cable 20 is made from metallic monofilaments 22 having a diameter of 60 μm. The monofilament is having a core 24 of low carbon steel (with a carbon content of 0.039% by weight) and a nickel sheath 26. The nickel sheath 26 is 4% by weight of the metallic monofilament. Seven of these metallic monofilaments are twisted together, providing a yarn 28 comprising seven of the metallic monofilaments. Eight of these yarns 28 are twisted together to obtain a cable, thus obtaining a 8*7 cable construction. The cable is coated with a PFA (perfluoroalcoxy) coating 29 of thickness 0.17 mm. At a temperature of 20° C., the heating cable has an electrical resistance of 0.765 Ω/m. Table 1 shows the effect of temperature on the electrical resistance in Ω/m of this cable. The test results are obtained by testing the resistance of the cable in an oven, bringing the heating cable at different temperatures.

TABLE 1

Electrical resistance in Ω/m as a function of temperature of low carbon steel cable 8 * 7 * 60 μm, with PFA coating

| Temperature (° C.) | Resistance (Ω/m) |
|---|---|
| −40 | 0.59 |
| −25 | 0.617 |
| 0 | 0.708 |
| 20 | 0.765 |
| 40 | 0.834 |
| 50 | 0.872 |
| 60 | 0.91 |
| 80 | 0.988 |
| 90 | 1.038 |
| 100 | 1.079 |
| 125 | 1.2 |

The increase of the electrical resistance of the cable is also illustrated by the formula R(T)=R0*(1+alpha*(T−T0)), wherein R(T) is the electrical resistance for the heating cable in Ω/m as a function of temperature T (in ° C.). R0 (in Ω/m) is the electrical resistance (in Ω/m) of the heating cable at reference temperature T0 (in ° C.). When having positive values, the coefficient alpha (in /° C.) is indicating the increase of the electrical resistance with increasing temperature of the heating cable. Table 2 provides the coefficient alpha for the 8*7*60 μm heating cable as a function of the temperature T of the formula, taking T0 and its corresponding electrical resistance R0 at 0° C. The values for the coefficient alpha are obtained by measuring the electrical resistance R(T) at different temperature T, and calculating the coefficient alpha out of the formula R(T)=R0*(1+alpha*(T−T0)), taking R0 at a temperature T0, T0 being at 0° C. for the calculation of alpha in Table 2. As the coefficient alpha increases for increasing values of the temperature T, the increase of electrical resistance of the heating cable with the temperature is increasing with increasing temperatures, meaning that a stronger safety effect is present at higher temperatures of the heating cable.

TABLE 2

Temperature coefficient alpha (/° C.) as a function of temperature for low carbon steel cable 8 * 7 * 60 μm, with PFA coating

| T (° C.) | R (Ω/m) | alpha (/° C.) |
|---|---|---|
| −40 | 0.59 | 0.00417 |
| −25 | 0.617 | 0.00514 |
| 0 | 0.708 | |

TABLE 2-continued

| Temperature coefficient alpha (/° C.) as a function of temperature for low carbon steel cable 8 * 7 * 60 μm, with PFA coating | | |
|---|---|---|
| T (° C.) | R (Ω/m) | alpha (/° C.) |
| 20 | 0.765 | 0.00403 |
| 40 | 0.834 | 0.00445 |
| 50 | 0.872 | 0.00463 |
| 60 | 0.91 | 0.00476 |
| 80 | 0.988 | 0.00494 |
| 90 | 1.038 | 0.00518 |
| 100 | 1.079 | 0.00524 |
| 125 | 1.2 | 0.00556 |

A similar experiment was performed on a heating cable made out of stainless steel filaments (not falling within the scope of the invention). The value alpha determined in the similar way was only 0.0003/° C. at 45° C. and 0.0006/° C. at 100° C.; indicating an almost non-existing increase of the electrical resistance with increasing temperatures.

In another example of carrying out the invention, a heating cable was made out of monofilaments of 60 μm diameter high carbon steel (and specifically high carbon steel with 0.7% carbon content). The monofilaments were having a sheath of zinc on their surface, with a mass percentage of 1.8% by weight of monofilament. Three of these monofilaments are twisted together. Seven of these twisted combinations are twisted together to form a cable. In a further example, the so-obtained cable is coated with a PFA-coating, with a coating thickness between 0.15 and 0.20 mm. The heating cable is having an electrical resistance of 3.6 Ω/m measured at 20° C.

In yet another example of carrying out the invention, a heating cable was made out of low carbon steel monofilaments (and specifically with a carbon content of 0.03% by weight) of 60 μm diameter. The construction of the heating cable was 4*7, meaning that in a first twisting operation seven monofilaments are twisted together. In a second twisting operation, four of these twisted combinations are twisted together to form the cable. The cable can be coated with a plastic material, such as PFA, with a coating thickness between 0.15 and 0.20 mm. The heating cable is having an electrical resistance of 1.55 Ω/m measured at 20° C.

In yet another example of carrying out the invention, a heating cable was made out of low carbon steel monofilaments (and specifically with a carbon content of 0.03% by weight) of 60 μm diameter. The construction of the heating cable was 11*7, meaning that in a first twisting operation seven monofilaments are twisted together. In a second twisting operation, eleven of these twisted combinations are twisted together to form the cable. The cable can be coated with a plastic material, such as PFA, with a coating thickness between 0.15 and 0.20 mm. The heating cable is having an electrical resistance of 0.563 Ω/m measured at 20° C.

Table 3 provides a list of further examples of the invention. The heating cables listed in table 3 are made out of high carbon steel monofilaments (high carbon steel with 0.7% carbon) or from low carbon steel monofilaments and are having a metallic sheath. The cable construction indicates how the heating cable is constructed. E.g. 7*3 means that in a first operation, three monofilaments are twisted or cabled together, and in a second operation, seven of the constructions made in the first twisting operation are cabled or twisted together to form the heating cable. The heating cable can be provided with or without a plastic or polymer coating.

TABLE 3

| Example of heating cables according to the invention | | | | | |
|---|---|---|---|---|---|
| Diameter mono-filament (μm) | Monofilament type | Cable con-struction | Resistance of the cable in Ω/m (at 20° C.) | Cable diam (mm) without plastic coating | Cable diam with plastic coating (mm) |
| 60 | High carbon + sheath zinc 1.8% by weight | 7 * 3 | 3.6 | 0.36 | 0.70 |
| 40 | High carbon + sheath zinc 1.8% by weight | 7 * 3 | 8 | 0.24 | 0.58 |
| 40 | High carbon + sheath zinc 1.8% by weight | 3 * 3 | 18.7 | 0.16 | 0.50 |
| 60 | High carbon + sheath zinc 1.8% by weight | 3 * 3 | 8.3 | 0.23 | 0.57 |
| 60 | Low carbon + sheath of nickel 4% by weight | 7 * 3 | 2.1 | 0.36 | 0.70 |
| 40 | Low carbon + sheath of nickel 4% by weight | 7 * 3 | 4.6 | 0.24 | 0.58 |
| 40 | Low carbon + sheath of nickel 4% by weight | 3 * 3 | 10.7 | 0.16 | 0.50 |
| 60 | Low carbon + sheath of nickel 4% by weight | 3 * 3 | 4.8 | 0.23 | 0.57 |
| 60 | Low carbon + sheath of nickel 4% by weight | 7 * 7 | 0.78 | 0.55 | 0.9 |

Another example is a heating cable made out of low carbon steel monofilaments (and specifically with a carbon content of 0.03% by weight) of 100 μm diameter. The construction of the heating cable was 7*3*7, meaning that in a first twisting operation seven monofilaments are twisted together. In a second twisting operation, three of these twisted combinations are twisted together to form a cord. Seven of these cords are twisted together to form the heating cable. The cable can be coated with a plastic material, such as PFA, with a coating thickness between 0.15 and 0.20 mm. The heating cable is having an electrical resistance of 0.1 Ω/meter at 20° C.

Other examples are using soft annealed nickel plated low carbon steel monofilaments of 60 μm diameter. Several cable constructions have been made e.g.

1*7 having an electrical resistance of 6.2 Ω/meter at 20° C.

2*7 having an electrical resistance of 3.1 Ω/meter at 20° C.

4*7 having an electrical resistance of 1.5 Ω/meter at 20° C.

6*7 having an electrical resistance of 1.1 Ω/meter at 20° C.

Each of the cables can be provided with a polymer sheath e.g. PFA or PA12. Such cables can e.g. be used in car seat heating. It is also possible to provide the individual soft annealed nickel plated low carbon steel monofilaments with a coating, e.g. with a polyurethane coating that is acting as safety feature if one or more of the metallic filaments would break during use of the heating cable.

Other examples are using end annealed nickel plated low carbon steel monofilaments of 80 μm diameter. Several cable constructions have been made e.g.

1*7 having an electrical resistance of 3.5 Ω/meter at 20° C.

2*7 having an electrical resistance of 1.7 Ω/meter at 20° C.

3*7 having an electrical resistance of 1.2 Ω/meter at 20° C.

Each of the cables can be provided with a polymer sheath, e.g. PFA or PA12. Such cables can e.g. be used in car seat heating.

Other examples are using end drawn annealed zinc plated low carbon steel monofilaments of 60 μm diameter. A 7*3 cable construction was made, having an electrical resistance of 1.2 Ω/meter at 20° C. The cable was provided with a PFA coating.

An alternative embodiment is a heating cable comprising metallic monofilaments of a first type and metallic monofilaments of a second type, in which the second type differs in composition from the first type. The metallic monofilaments of a first type are forty monofilaments with a nickel sheet of 4% (by mass) and a diameter of 60 μm. These metallic monofilaments of a first type are combined with the metallic monofilaments of a second type, being three monofilaments of 190 μm diameter that are having a steel core and a copper sheath. The copper sheath has a layer thickness of 19 μm. The so formed cable has an electrical resistance of 0.345 Ω/m and can be used as such. The cable can also be coated. The same cable was made and coated with PFA (perfluoroalkoxy) with a coating thickness of 0.28 mm.

The invention claimed is:

1. A heating cable comprises between seven and two hundred metallic monofilaments of a first type, which are electrical conductors configured to generate heat, wherein the metallic monofilaments of a first type have a diameter between 30 μm and 100 μm, wherein the metallic monofilaments of a first type have a substantially round cross section, wherein the metallic monofilaments of a first type comprise a steel layer with a chromium content of less than 10% by weight;

wherein the metallic monofilaments of a first type comprise a corrosion resistant coating layer;

wherein the heating cable comprises a metallic monofilament of a second type or one or more bundles of metallic monofilaments of a second type; and wherein the metallic monofilament of the second type differs in composition from the metallic monofilament of the first type;

and wherein the heating cable has an electrical resistance ranging between 0.1 Ω/m and 20.0 Ω/m when measured at 20° C.

2. The heating cable of claim 1, wherein the steel layer with a chromium content of less than 10% is a low carbon steel grade.

3. The heating cable of claim 1, wherein the steel layer with a chromium content of less than 10% is a high carbon steel grade.

4. The heating cable of claim 1, wherein the corrosion resistant coating is a metal coating selected from the group consisting of zinc, tin, silver, nickel, aluminum, or an alloy thereof.

5. The heating cable of claim 1, wherein the corrosion resistant coating is a polymer.

6. The heating cable of claim 1, wherein the heating cable has a corrosion resistant sheath.

7. The heating cable of claim 6, wherein the corrosion resistant sheath comprises a polymer layer.

8. The heating cable of claim 7, wherein the polymer layer comprises fluorine in the polymer.

9. A method for making a heating cable with an electrical resistance ranging between 0.1 Ω/m and 20.0 Ω/m when measured at 20° C., the method comprising the steps of selecting between seven and two hundred metallic monofilaments of a first type, wherein the metallic monofilaments of the first type have a diameter ranging from 30 μm to 100 μm, wherein the metallic monofilaments of the first type have a substantially round cross section, wherein the metallic monofilaments of a first type comprise a steel layer with a chromium content of less than 10% by weight; and selecting a metallic monofilament of a second type or one or more bundles of metallic monofilaments of the second type; and twisting and/or cabling the monofilaments of the first type and the metallic monofilaments of the second type to form the heating cable.

* * * * *